US010718163B2

(12) United States Patent
Gilbrech

(10) Patent No.: US 10,718,163 B2
(45) Date of Patent: Jul. 21, 2020

(54) PULSE TRANSFORMER FOR DOWNHOLE ELECTROCRUSHING DRILLING

(71) Applicants: Halliburton Energy Services, Inc., Houston, TX (US); Chevron U.S.A. Inc., San Ramon, CA (US); SDG LLC, Minden, NV (US)

(72) Inventor: Joshua A. Gilbrech, Albuquerque, NM (US)

(73) Assignees: Halliburton Energy Services, Inc., Houston, TX (US); Chevron U.S.A. Inc., San Ramon, CA (US); SDG LLC, Minden, NV (US)

( * ) Notice: Subject to any disclaimer, the term of this patent is extended or adjusted under 35 U.S.C. 154(b) by 251 days.

(21) Appl. No.: 15/750,406

(22) PCT Filed: Apr. 3, 2017

(86) PCT No.: PCT/US2017/025751
§ 371 (c)(1),
(2) Date: Feb. 5, 2018

(87) PCT Pub. No.: WO2018/186828
PCT Pub. Date: Oct. 11, 2018

(65) Prior Publication Data

US 2018/0313158 A1 Nov. 1, 2018

(51) Int. Cl.
*E21B 7/15* (2006.01)
*E21C 37/18* (2006.01)
*E21B 10/00* (2006.01)

(52) U.S. Cl.
CPC ..... *E21B 7/15* (2013.01); *E21B 10/00* (2013.01); *E21C 37/18* (2013.01)

(58) Field of Classification Search
CPC ..... E21B 7/15; E21B 41/0085
See application file for complete search history.

(56) References Cited

U.S. PATENT DOCUMENTS 2,835,785 A * 5/1958 Williams ..... B23H 1/00 219/69.18
2,930,137 A * 3/1960 Arps ..... E21B 47/02 33/312

(Continued)

FOREIGN PATENT DOCUMENTS

WO 2013/070609 5/2013
WO 2015/124733 8/2015

OTHER PUBLICATIONS

International Preliminary Report on Patentability for PCT Patent Application No. PCT/US2017/025751, dated Oct. 17, 2019; 11 pages.

(Continued)

*Primary Examiner* — Shane Bomar
(74) *Attorney, Agent, or Firm* — Baker Botts L.L.P.

(57) ABSTRACT

A downhole drilling system is disclosed. The downhole drilling system may include a pulse-generating circuit electrically coupled to a power source configured to provide an alternating current at a frequency and an input voltage, the pulse-generating circuit comprising an input stage circuit electrically coupled to the power source, the input stage circuit configured to control the alternating current in the pulse-generating circuit; a transformer circuit electrically coupled to the input stage circuit, the transformer circuit comprising an open-core transformer configured to generate an output voltage higher than the input voltage; and an output stage circuit electrically coupled to the transformer circuit, the output stage circuit configured to store energy for an electric pulse; and a drill bit including a first electrode and a second electrode electrically coupled to the output stage circuit to receive the electric pulse from the pulse-generating circuit.

21 Claims, 7 Drawing Sheets

(56) References Cited

U.S. PATENT DOCUMENTS

| | | | | |
|---|---|---|---|---|
| 3,071,690 | A * | 1/1963 | Fearon | G01V 5/107 376/118 |
| 3,142,029 | A * | 7/1964 | Keen, Jr. | H01F 27/2847 336/84 R |
| 3,387,203 | A * | 6/1968 | Munnelly | H03B 19/03 363/171 |
| 3,489,970 | A * | 1/1970 | Wanlass | H03K 17/82 334/12 |
| 4,343,356 | A * | 8/1982 | Riggs | E21B 36/04 166/248 |
| 6,104,707 | A | 8/2000 | Abraham | |
| 7,394,226 | B1 | 7/2008 | Adler | |
| 10,113,364 | B2 * | 10/2018 | Moeny | E21B 7/15 |
| 2001/0022540 | A1 * | 9/2001 | Hill | H03C 3/16 332/102 |
| 2010/0224356 | A1 | 9/2010 | Moore | |
| 2012/0168177 | A1 * | 7/2012 | Moeny | E21B 7/15 166/380 |
| 2012/0235829 | A1 * | 9/2012 | Adnan | E21B 41/00 340/854.9 |
| 2013/0071286 | A1 * | 3/2013 | Watson | A61M 16/12 422/22 |
| 2013/0081874 | A1 | 4/2013 | Gutsol | |
| 2013/0140086 | A1 | 6/2013 | Moeny | |
| 2014/0008073 | A1 * | 1/2014 | Rey-Bethbeder | E21B 36/04 166/308.1 |
| 2014/0008968 | A1 * | 1/2014 | Moeny | E21B 7/15 307/2 |
| 2016/0017663 | A1 * | 1/2016 | Moeny | E21B 7/15 175/327 |
| 2017/0067292 | A1 | 3/2017 | Bayol et al. | |
| 2017/0350197 | A1 * | 12/2017 | Sugiura | E21B 47/12 |
| 2018/0053973 | A1 * | 2/2018 | Tong | G01R 33/3456 |

OTHER PUBLICATIONS

Examination Report for GCC Patent Application No. 2018-34995, dated Oct. 23, 2019; 4 pages.

International Search Report and Written Opinion for PCT Patent Application No. PCT/US2017/025751, dated Nov. 20, 2017; 17 pages.

O'Loughlin, J.P.; Sidler, J.D.; Rohwein, G.J., "Air core pulse transformer design," in Power Modulator Symposium, 1988. IEEE Conference Record of the 1988 Eighteenth , vol., No., pp. 325-330, Jun. 20-22, 1988; 6 pages.

Rohwein, G. J., et al. "An scr-switched, high voltage, high gain linear transformer system." Pulsed Power Conference, 1989. 7th. IEEE, 1989.; 4 pages.

Lawson, R.N.; Rohwein, G.J., "A study of compact, lightweight, high voltage inductors with partial magnetic cores," in Pulsed Power Conference, 1989. 7th , vol., No., pp. 906-908, 1989; 3 pages.

G. J. Rohwein, "A low-impedance, high-voltage direct drive transformer system," Power Modulator Symposium, 1988. IEEE Conference Record of the 1988 Eighteenth. Hilton Head, SC, 1988, pp. 331-335; 5 pages.

Shotts, Zac, et al. "Design Methodology for Dual Resonance Pulse Transformers." Pulsed Power Conference, 2005 IEEE. IEEE, 2005; 4 pages.

Uglum, J.R. "Theory of the Resonant Transformer Accelerator and some Design Considerations." Energy Sciences Inc., Aug. 1973; 42 pages.

"Dupont Kapton: Summary of Properties." Retrieved from url: http://www.dupont.com/content/dam/dupont/products-and-services/membranes-and-films/polyimde-films/documents/DEC-Kapton-summary-of-properties.pdf, 2017; 20 pages.

Lim, Soo Won, et al. "Fabrication and operation testing of a dual resonance pulse transformer for PFL pulse charging." Journal of the Korean Physical Society 59.61 (2011): 3679-3682; 4 pages.

Lawson, R. N., and G. J. Rohwein. *Partial core pulse transformer*. U.S. Pat. No. 7,764,253. Sandia National Labs., Albuquerque, NM (United States), 1991.

Adler, R. J., and V. M. Weeks. "Design and operation of a 700 kV arbitrary waveform generator." *Pulsed Power Conference, 2009. PPC'09. IEEE*. IEEE, 2009.

* cited by examiner

PULSE TRANSFORMER FOR DOWNHOLE ELECTROCRUSHING DRILLING

RELATED APPLICATIONS

This application is a U.S. National Stage Application of International Application No. PCT/US2017/025751 filed Apr. 3, 2017, which designates the United States, and which is incorporated herein by reference in its entirety.

TECHNICAL FIELD

The present disclosure relates generally to downhole electrocrushing drilling and, more particularly, to pulse transformers for downhole electrocrushing drilling.

BACKGROUND

Electrocrushing drilling uses pulsed power technology to drill a wellbore in a rock formation. Pulsed power technology repeatedly applies a high electric potential across the electrodes of an electrocrushing drill bit, which ultimately causes the surrounding rock to fracture. The fractured rock is carried away from the bit by drilling fluid and the bit advances downhole.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Electrocrushing drilling may be used to form wellbores in subterranean rock formations for recovering hydrocarbons, such as oil and gas, from these formations. Electrocrushing drilling uses pulsed-power technology to repeatedly fracture the rock formation by repeatedly delivering high-energy electrical pulses to the rock formation. In some applications, certain components of a pulsed-power system may be located downhole. For example, a pulse-generating circuit may be located in a bottom-hole assembly (BHA) near the electrocrushing drill bit. The pulse-generating circuit may include a transformer that steps up a low-voltage power source input into a high-voltage output that is used to generate electric pulses for powering electrodes of an electrocrushing drill bit. In addition, the pulse-generating circuit may be designed to withstand the harsh environment of a downhole pulsed-power system. For example, the pulse-generating circuit may operate over a wide temperature range (for example, from approximately 10 to 200 degrees Centigrade), and may physically withstand the vibration and mechanical shock resulting from the fracturing of rock during downhole electrocrushing drilling.

There are numerous ways in which a pulse-generating circuit may be implemented in a downhole electrocrushing pulsed-power system. Thus, embodiments of the present disclosure and its advantages are best understood by referring to FIGS. 1 through 6, where like numbers are used to indicate like and corresponding parts.

Figure 1:
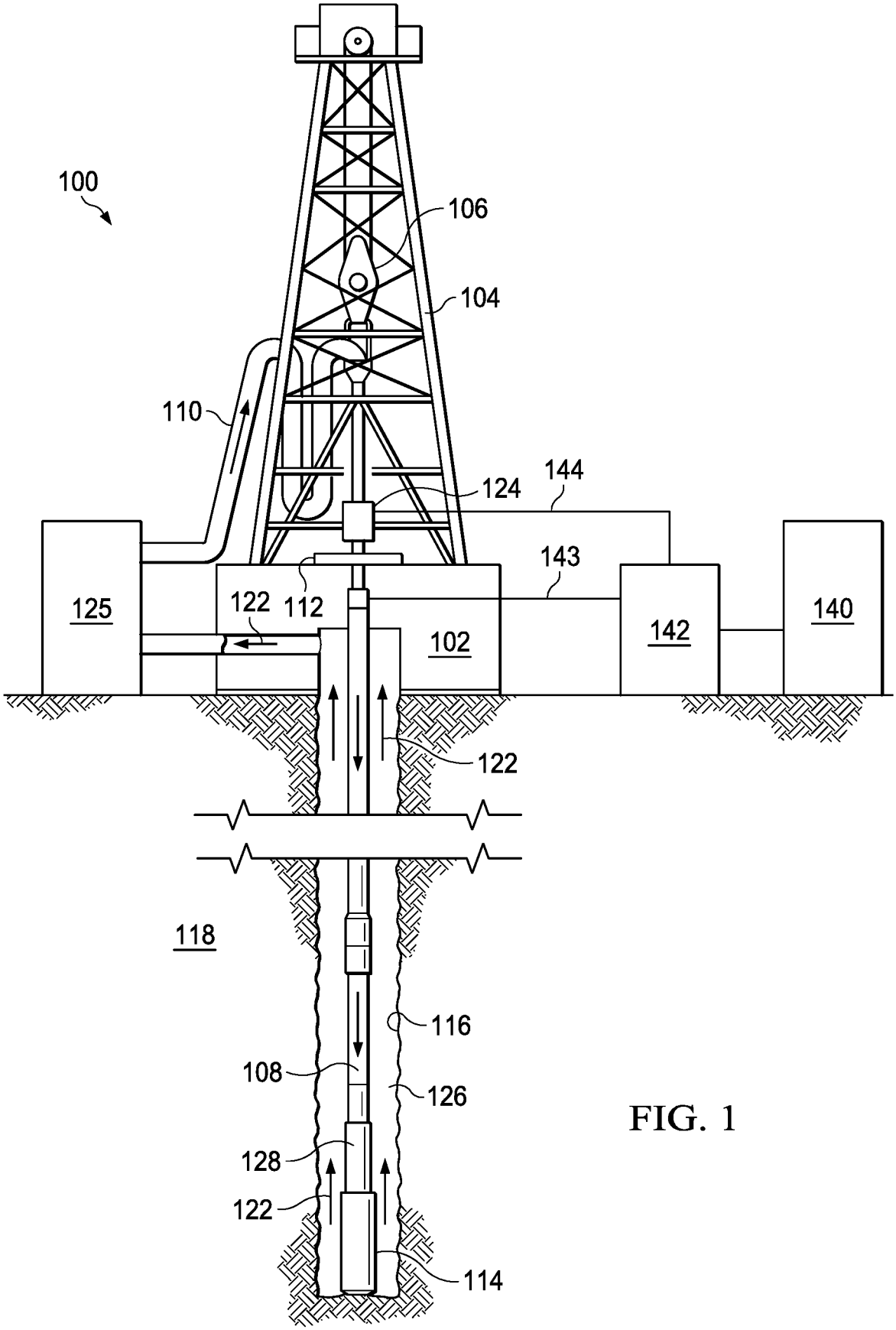
FIG. 1 is an elevation view of an exemplary downhole electrocrushing drilling system used in a wellbore environment.

FIG. 1 is an elevation view of an exemplary electrocrushing drilling system used to form a wellbore in a subterranean formation. Although FIG. 1 shows land-based equipment, downhole tools incorporating teachings of the present disclosure may be satisfactorily used with equipment located on offshore platforms, drill ships, semi-submersibles, and drilling barges (not expressly shown in FIG. 1). Additionally, while wellbore 116 is shown as being a generally vertical wellbore, wellbore 116 may be any orientation including generally horizontal, multilateral, or directional.

Drilling system 100 includes drilling platform 102 that supports derrick 104 having traveling block 106 for raising and lowering drill string 108. Drilling system 100 also includes pump 125, which circulates electrocrushing drilling fluid 122 through a feed pipe to kelly 110, which in turn conveys electrocrushing drilling fluid 122 downhole through interior channels of drill string 108 and through one or more orifices in electrocrushing drill bit 114. Electrocrushing drilling fluid 122 then circulates back to the surface via annulus 126 formed between drill string 108 and the sidewalls of wellbore 116. Fractured portions of the formation are carried to the surface by electrocrushing drilling fluid 122 to remove those fractured portions from wellbore 116.

Electrocrushing drill bit 114 is attached to the distal end of drill string 108. Power to electrocrushing drill bit 114 may be supplied from the surface. For example, generator 140 may generate electrical power and provide that power to power-conditioning unit 142. Power-conditioning unit 142 may then transmit electrical energy downhole via surface cable 143 and a sub-surface cable (not expressly shown in FIG. 1) contained within drill string 108 or attached to the side of drill string 108. A pulse-generating circuit within BHA 128 may receive the electrical energy from power-conditioning unit 142, and may generate high-energy pulses to drive electrocrushing drill bit 114. The pulse-generating circuit may include an open-core, multi-segmented transformer as described in further detail below with reference to FIGS. 3-6.

The pulse-generating circuit within BHA 128 may be utilized to repeatedly apply a high electric potential, for example at least 50 kilovolts (kV) or between approximately 50 kV and 200 kV, across the electrodes of electrocrushing drill bit 114. Each application of electric potential is referred to as a pulse. When the electric potential across the electrodes of electrocrushing drill bit 114 is increased enough during a pulse to generate a sufficiently high electric field, an electrical arc forms through a rock formation at the bottom of wellbore 116. The arc temporarily forms an electrical coupling between the electrodes of electrocrushing drill bit 114, allowing electric current to flow through the arc inside a portion of the rock formation at the bottom of wellbore 116. The arc greatly increases the temperature and pressure of the portion of the rock formation through which the arc flows and the surrounding formation and materials. The temperature and pressure is sufficiently high to break the rock into small bits or cuttings. This fractured rock is removed, typically by electrocrushing drilling fluid 122, which moves the fractured rock away from the electrodes and uphole. The terms "uphole" and "downhole" may be used to describe the location of various components of drilling system 100 relative to the bottom or end of wellbore 116 shown in FIG. 1. For example, a first component described as uphole from a second component may be further away from the end of wellbore 116 than the second component. Similarly, a first component described as being downhole from a second component may be located closer to the end of wellbore 116 than the second component.

As electrocrushing drill bit 114 repeatedly fractures the rock formation and electrocrushing drilling fluid 122 moves the fractured rock uphole, wellbore 116, which penetrates various subterranean rock formations 118, is created. Wellbore 116 may be any hole drilled into a subterranean formation or series of subterranean formations for the purpose of exploration or extraction of natural resources such as, for example, hydrocarbons, or for the purpose of injection of fluids such as, for example, water, wastewater, brine, or water mixed with other fluids. Additionally, wellbore 116 may be any hole drilled into a subterranean formation or series of subterranean formations for the purpose of geothermal power generation.

Although drilling system 100 is described herein as utilizing electrocrushing drill bit 114, drilling system 100 may also utilize an electrohydraulic drill bit. An electrohydraulic drill bit may have one or more electrodes and electrode spacing configurations similar to electrocrushing drill bit 114. But, rather than generating an arc within the rock, an electrohydraulic drill bit applies a large electrical potential across the one or more electrodes and the ground ring to form an arc across the drilling fluid proximate the bottom of wellbore 116. The high temperature of the arc vaporizes the portion of the fluid immediately surrounding the arc, which in turn generates a high-energy shock wave in the remaining fluid. The one or more electrodes of electrohydraulic drill bit may be oriented such that the shock wave generated by the arc is transmitted toward the bottom of wellbore 116. When the shock wave hits and bounces off of the rock at the bottom of wellbore 116, the rock fractures. Accordingly, drilling system 100 may utilize pulsed-power technology with an electrohydraulic drill bit to drill wellbore 116 in subterranean formation 118 in a similar manner as with electrocrushing drill bit 114.

Figure 2A:
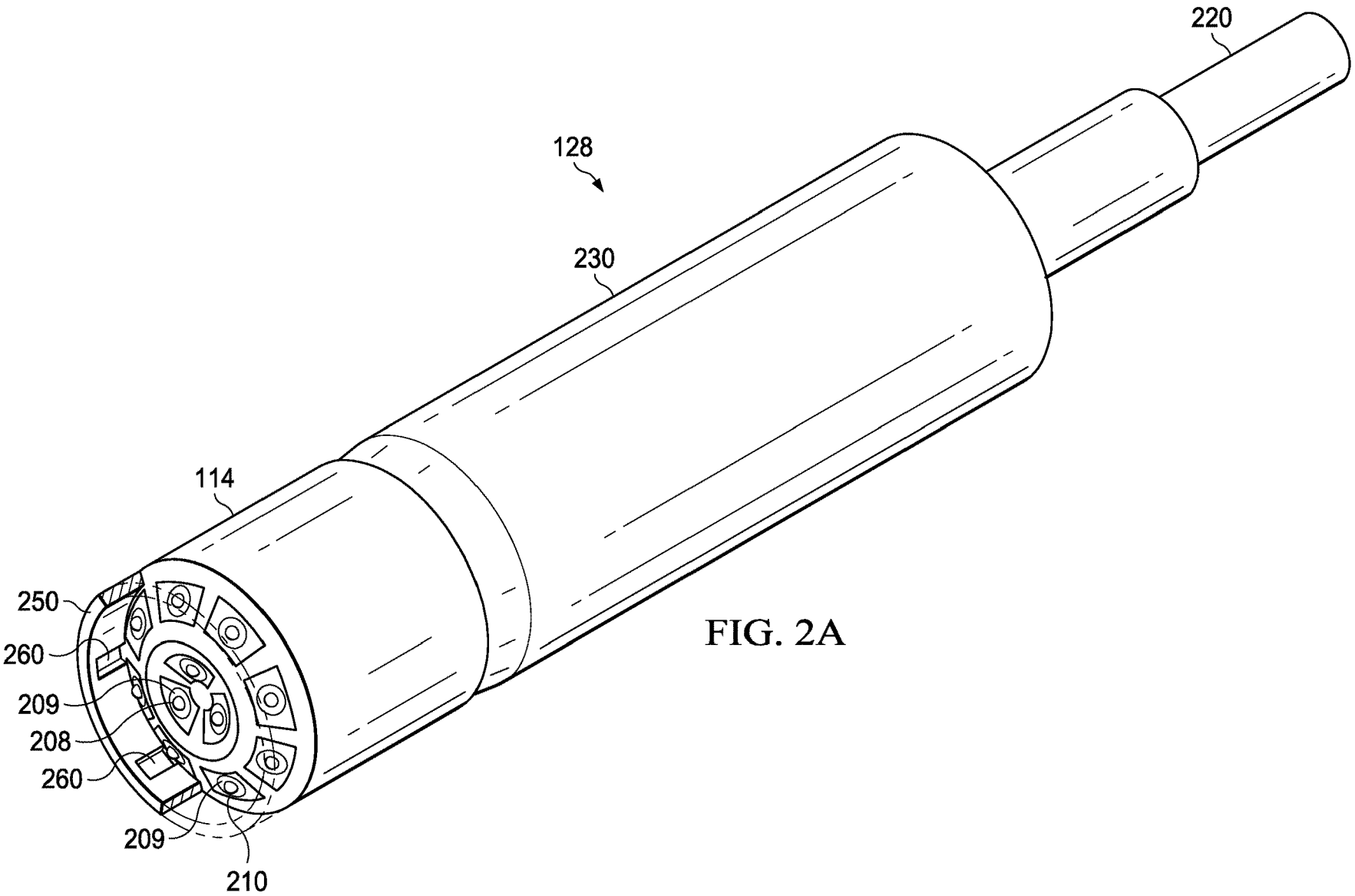
FIG. 2A is a perspective view of exemplary components of a bottom-hole assembly for a downhole electrocrushing drilling system.

FIG. 2A is a perspective view of exemplary components of the bottom-hole assembly for downhole electrocrushing drilling system 100. BHA 128 may include pulsed-power tool 230. BHA 128 may also include electrocrushing drill bit 114. For the purposes of the present disclosure, electrocrushing drill bit 114 may be integrated within BHA 128, or may be a separate component that is coupled to BHA 128.

Pulsed-power tool 230 may provide pulsed electrical energy to electrocrushing drill bit 114. Pulsed-power tool 230 receives electrical power from a power source via cable 220. For example, pulsed-power tool 230 may receive electrical power via cable 220 from a power source located on the surface as described above with reference to FIG. 1, or from a power source located downhole such as a generator powered by a mud turbine. Pulsed-power tool 230 may also receive electrical power via a combination of a power source located on the surface and a power source located downhole. Pulsed-power tool 230 converts electrical power received from the power source into high-energy electrical pulses that are applied across electrodes 208 and ground ring 250 of electrocrushing drill bit 114. Pulsed-power tool 230 may also apply high-energy electrical pulses across electrode 210 and ground ring 250 in a similar manner as described herein for electrode 208 and ground ring 250. To generate high-energy electrical pulses, pulsed-power tool 230 may include a pulse-generating circuit as described below with reference to FIG. 3.

Referring to FIG. 1 and FIG. 2A, electrocrushing drilling fluid 122 may exit drill string 108 via openings 209 surrounding each electrode 208 and each electrode 210. The flow of electrocrushing drill fluid 122 out of openings 209 allows electrodes 208 and 210 to be insulated by the electrocrushing drilling fluid. Electrocrushing drill bit 114 may include a solid insulator (not expressly shown in FIG. 1 or 2A) surrounding electrodes 208 and 210 and one or more orifices (not expressly shown in FIG. 1 or 2A) on the face of electrocrushing drill bit 114 through which electrocrushing drilling fluid 122 exits drill string 108. Such orifices may be simple holes, or they may be nozzles or other shaped features. Because fines are not typically generated during electrocrushing drilling, as opposed to mechanical drilling, electrocrushing drilling fluid 122 may not need to exit the drill bit at as high a pressure as the drilling fluid in mechanical drilling. As a result, nozzles and other features used to increase drilling fluid pressure may not be needed. However, nozzles or other features to increase electrocrushing drilling fluid 122 pressure or to direct electrocrushing drilling fluid may be included for some uses.

Electrocrushing drilling fluid 122 is typically circulated through drilling system 100 at a flow rate sufficient to remove fractured rock from the vicinity of electrocrushing drill bit 114. In addition, electrocrushing drilling fluid 122 may be under sufficient pressure at a location in wellbore 116, particularly a location near a hydrocarbon, gas, water, or other deposit, to prevent a blowout.

In addition, electrocrushing drill bit 114 may include ground ring 250, shown in part in FIG. 2A. Ground ring 250 may function as an electrode. Although illustrated as a contiguous ring in FIG. 2A, ground ring 250 may be non-contiguous discrete electrodes and/or implemented in different shapes. Electrodes 208 and 210 may be at least 0.4 inches (i.e., at least approximately 10 millimeters) apart from ground ring 250 at their closest spacing, at least 1 inch (i.e., at least approximately 25 millimeters) apart at their closest spacing, at least 1.5 inches (i.e., at least approximately 38 millimeters) apart at their closest spacing, or at least 2 inches (i.e., at least approximately 51 millimeters) apart at their closest spacing. If drilling system 100 experiences vaporization bubbles in electrocrushing drilling fluid 122 near electrocrushing drill bit 114, the vaporization bubbles may have deleterious effects. For instance, vaporization bubbles near electrodes 208 or 210 may impede formation of the arc in the rock. Electrocrushing drilling fluid 122 may be circulated at a flow rate also sufficient to remove vaporization bubbles from the vicinity of electrocrushing drill bit 114. Although not all electrocrushing drill bits 114 may have ground ring 250, if it is present, it may contain passages 260 to permit the flow of electrocrushing drilling fluid 122 along with any fractured rock or bubbles away from electrodes 208 and 210 and uphole.

Figure 2B:
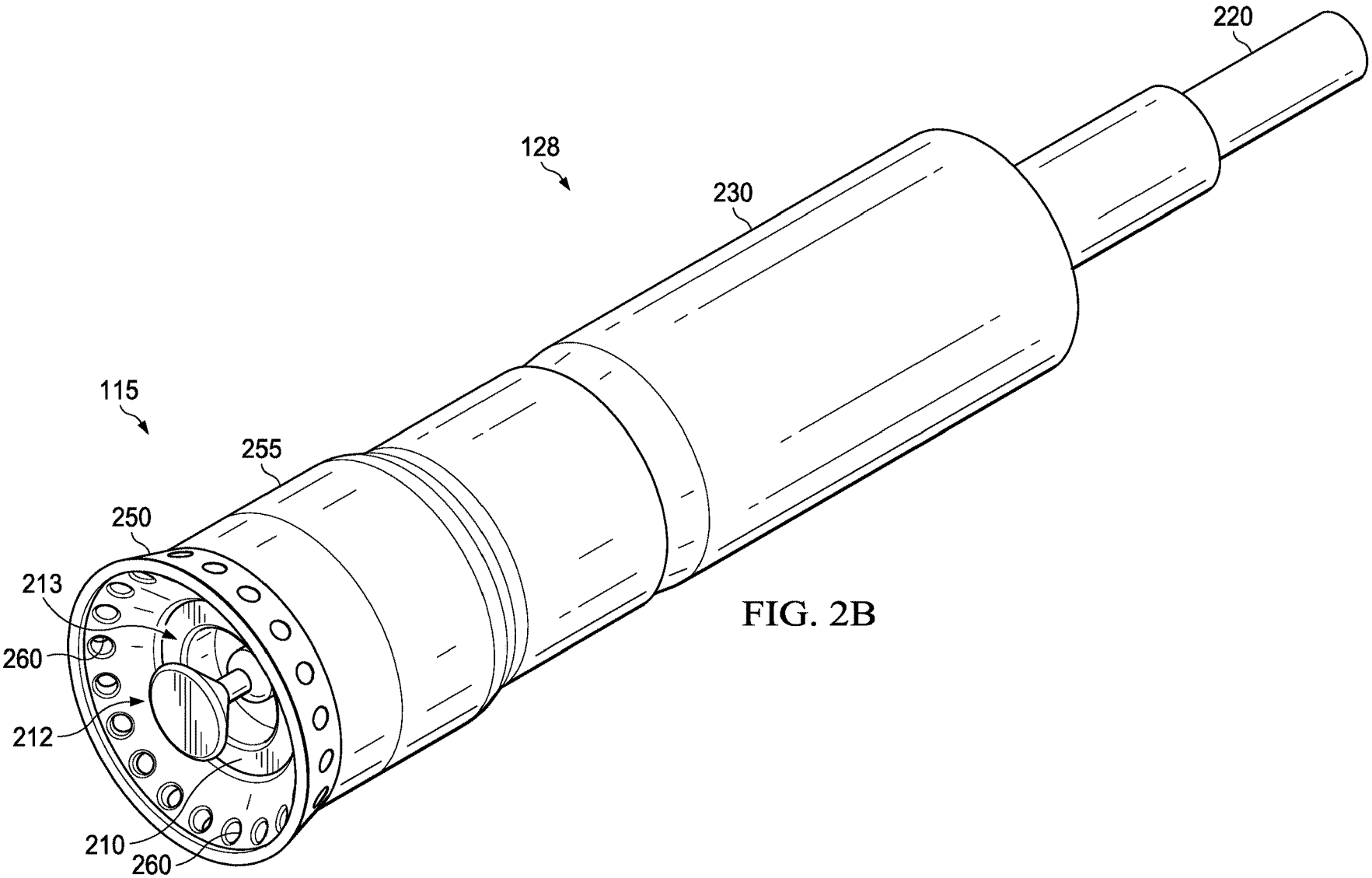
FIG. 2B is a perspective view of exemplary components of a bottom-hole assembly for a downhole electrocrushing drilling system.

FIG. 2B is another perspective view of exemplary components of a bottom-hole assembly for downhole electrocrushing drilling system 100. BHA 128 and pulsed-power tool 230 may include the same features and functionalities discussed above in FIG. 2A. For example, electrocrushing drilling fluid 122 may exit drill string 108 via opening 213 surrounding electrode 212. The flow of electrocrushing drill fluid 122 out of opening 213 allows electrode 212 to be insulated by the electrocrushing drilling fluid. While one electrode 212 is shown in FIG. 2B, electrocrushing drill bit 115 may include multiple electrodes 212. Electrocrushing drill bit 115 may include solid insulator 210 surrounding electrode 212 and one or more orifices (not expressly shown in FIG. 2B) on the face of electrocrushing drill bit 115 through which electrocrushing drilling fluid 122 exits drill string 108. Nozzles or other features to increase electrocrushing drilling fluid 122 pressure or to direct electrocrushing drilling fluid may be included for some uses. Additionally, the shape of solid insulator 210 may be selected to enhance the flow of electrocrushing drilling fluid 122 around the components of electrocrushing drill bit 115.

Electrocrushing drill bit 115 may include bit body 255, electrode 212, ground ring 250, and solid insulator 210. Electrode 212 may be placed approximately in the center of electrocrushing drill bit 115. The distance between electrode 212 and ground ring 250 may be generally symmetrical or may be asymmetrical such that the electric field surrounding the electrocrushing drill bit has a symmetrical or asymmetrical shape. The distance between electrode 212 and ground ring 250 allows electrocrushing drilling fluid 122 to flow between electrode 212 and ground ring 250 to remove vaporization bubbles from the drilling area.

Electrode 212 may have any suitable diameter based on the drilling operation. For example, electrode 212 may have a diameter between approximately two and ten inches (i.e., between approximately 51 and 254 millimeters). The diameter of the electrode may be based on the diameter of electrocrushing drill bit 115.

Ground ring 250 may function as an electrode and provide a location on the electrocrushing drill bit where an arc may initiate and/or terminate. Ground ring 250 also provides one or more fluid flow ports 260 such that electrocrushing drilling fluids flow through fluid flow ports 260 carry fractured rock and vaporization bubbles away from the drilling area.

Figure 3:
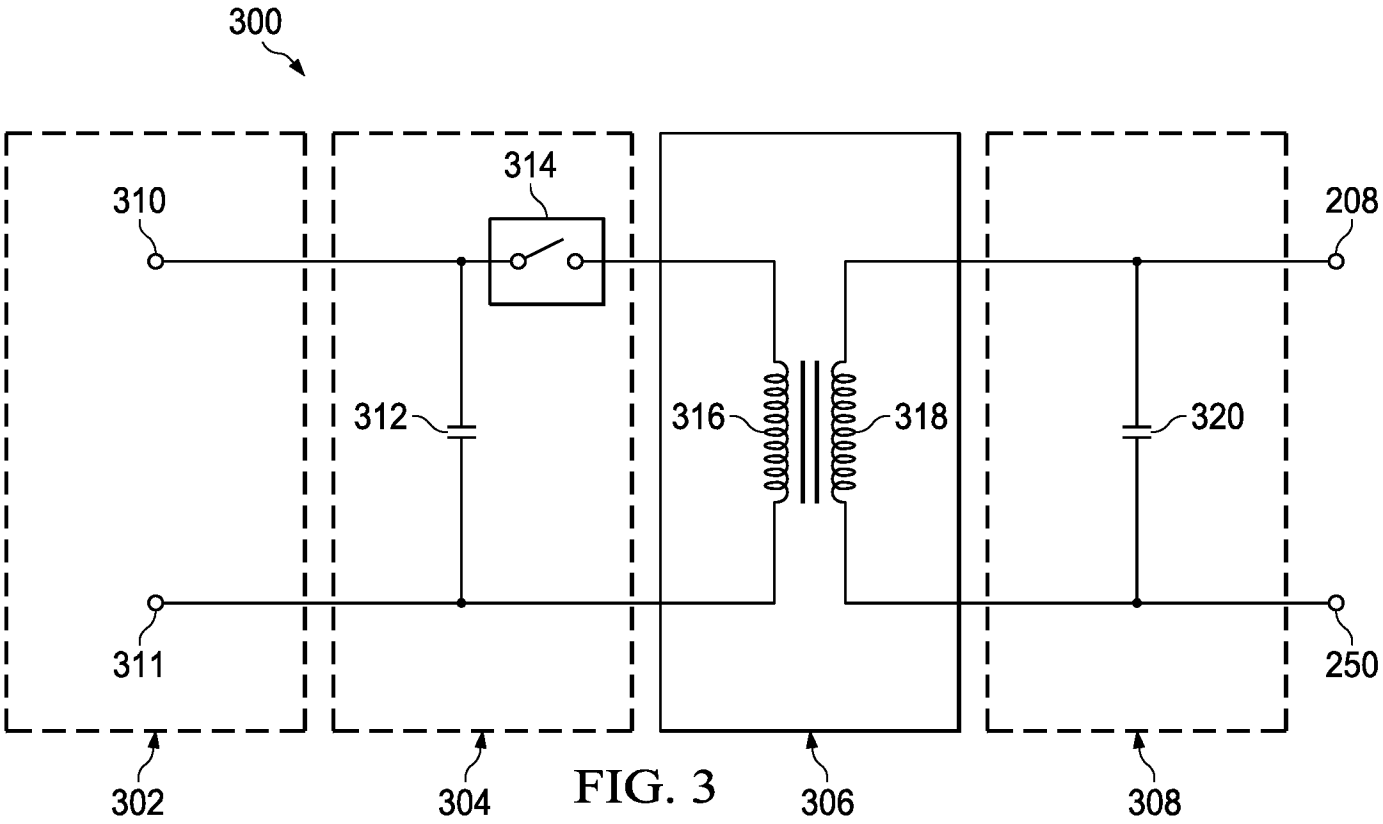
FIG. 3 is a schematic for an exemplary pulse-generating circuit for a downhole electrocrushing drilling system.

FIG. 3 is a schematic for an exemplary pulse-generating circuit for a downhole electrocrushing drilling system. Pulse-generating circuit 300 includes power source input 302, input stage circuit 304, transformer circuit 306, and output stage circuit 308.

As described above with reference to FIGS. 2A and 2B, pulse-generating circuit 300 receives electrical power from a power source located on the surface (for example, generator 140 described with reference to FIG. 1) and/or a power source located downhole, such as a generator powered by a mud turbine or an alternator. For example, input terminals 310 and 311 of power source input 302 may receive an alternating input current from a low-voltage (for example, a peak voltage between approximately 1 kV to 15 kV) power source by way of a cable, such as cable 220 described above with respect to FIGS. 2A and 2B. Input stage circuit 304 receives power from power source input 302 and controls the power supplied to transformer circuit 306. Transformer circuit 306 in turn transforms the low-voltage input into a high-voltage output that is used to create electrical pulses capable of applying at least 50 kV or between approximately 50 kV and 200 kV with a rise time of approximately 5 to 25 microseconds across electrodes 208 or 210 and ground ring 250 of electrocrushing drill bit 114 illustrated in FIG. 2A or electrode 212 and ground ring 250 of electrocrushing drill bit 115 illustrated in FIG. 2B. As described above with reference to FIGS. 1 and 2, the high-energy electrical pulses at electrodes 208, 210, and 212 are utilized to drill wellbore 116 in subterranean formation 118.

Input stage circuit 304 is electrically driven by power source input 302. Input stage circuit 304 includes capacitor 312 and switching circuit 314 electrically coupled to power source input 302. An alternating current is applied to input terminals 310 and 311 of power source input 302 that charges the plates of capacitor 312 such that capacitor 312 stores energy from power source input 302. Switching circuit 314 controls the flow of current to transformer circuit 306. Switching circuit 314 includes any suitable device to open and close the electrical path between capacitor 312 and transformer circuit 306. For example, switching circuit 314 may include a mechanical switch, a solid-state switch, a magnetic switch, a gas switch, or any other type or combination of switches (for example, an assembly of switches arranged in parallel or in series) suitable to open and close the electrical path between capacitor 312 and inductor 316. When switching circuit 314 is closed, electrical current flows from capacitor 312 and/or input terminals 310 and 311 to transformer circuit 306. Thus, switching circuit 314 controls the timing of power pulses supplied to the input side of transformer circuit 306. The current supplied to the input side of transformer circuit 306 may be between approximately 4 kA and 40 kA. Input stage circuit 304 may include one or more additional components (for example, a capacitor, resistor, and/or inductor) beyond those shown in FIG. 3 to condition or control power from power source input 302 before it is supplied to transformer circuit 306.

Transformer circuit 306 includes primary windings 316 and secondary windings 318 configured as a voltage step-up transformer. For example, primary windings 316, windings electrically coupled to input stage circuit 304 on the input or primary side, may be wound around the same core as secondary windings 318, windings electrically coupled to output stage 308 on the output or secondary side, to form an electrical transformer. Current from input stage circuit 304 flowing through primary windings 316 creates electromagnetism that induces a current through secondary windings 318 on the secondary side of transformer circuit 306. As described in more detail below with respect to FIGS. 4A and 4B, transformer circuit 306 may be an open-core, multi-segmented transformer that steps up or increases the voltage on the secondary side of pulse-generating circuit 300. For example, transformer circuit 306 may transform a low-voltage (for example, approximately 1 kV to 15 kV) from power source input 302 into a high voltage of at least 50 kV or between approximately 50 kV and 200 kV that is capable of creating high-energy electrical pulses to perform electrocrushing and/or electrohydraulic drilling. The open-core, multi-segmented design of transformer circuit 306 allows pulse-generating circuit 300 to fit within a bottom-hole assembly (for example, BHA 128 discussed above with respect to FIGS. 1 and 2) and generate high-energy pulses to perform electrocrushing and/or electrohydraulic drilling with a drill bit (for example, drill bits 114 and 115 discussed above with respect to FIGS. 2A and 2B).

Output stage circuit 308 stores energy from transformer circuit 306 to apply to the electrodes of an electrocrushing and/or electrohydraulic drill bit. Capacitor 320 is coupled to transformer circuit 306 such that it stores energy from the increased voltage generated on the secondary or output side of transformer circuit 306. Electrode 208 and ground ring 250 are coupled to opposing terminals of capacitor 320 of output stage circuit 308. Accordingly, as the electric potential across capacitor 320 increases, the electric potential across electrode 208 and ground ring 250 also increases. Electrode 208 and ground ring 250 are part of electrocrushing drill bit 114 described above with reference to FIGS. 1 and 2A. When the electric potential across, for example, electrode 208 and ground ring 250 of an electrocrushing drill bit becomes sufficiently large, an electrical arc forms through a rock formation that is near electrode 208 and ground ring 250. The arc provides a temporary electrical short between electrode 208 and ground ring 250, and thus allows electric current to flow through the arc inside a portion of the rock formation at the bottom of wellbore. As described above with reference to FIG. 1, the arc increases the temperature of the portion of the rock formation through which the arc flows and the surrounding formation and materials. The temperature is sufficiently high to vaporize any water or other fluids that might be touching or near the arc and may also vaporize part of the rock itself. The vaporization process creates a high-pressure gas which expands and, in turn, fractures the surrounding rock.

Although FIG. 3 is a schematic for a particular pulse-generating circuit topology, electrocrushing and/or electrohydraulic drilling systems and pulsed-power tools may utilize any suitable pulse-generating circuit topology to generate and apply high-energy pulses to electrode 208 and ground ring 250. These pulse-generating circuit topologies may utilize a voltage step-up transformer to generate a high voltage that is used to create high-energy electrical pulses required for electrocrushing and/or electrohydraulic drilling. Elements may be added or removed from the schematic illustrated in FIG. 3 without deviating from the present invention. For example, additional elements may be added to input stage circuit 304 to condition the power from power source input 302 before it is supplied to transformer circuit 306. Although electrode 208 and ground ring 250 are shown in FIG. 3, pulse-generating circuit 300 may supply high-energy electrical pulses to other electrodes, such as 208 or 210 and ground ring 250 of electrocrushing drill bit 114 or electrode 212 and ground ring 250 of electrocrushing drill bit 115 respectively described above with reference to FIGS. 2A and 2B. The individual circuit elements in pulse-generating circuit 300 may be selected based on the operating characteristics, such as voltage, current, and/or frequency, of power source input 302, and/or the on the desired performance of the drill bit and/or pulse-generating circuit. For example, when power source input 302 operates at a frequency of 5 kilohertz (kHz), a combined primary current between approximately 4 kA and 40 kA, and a voltage between approximately 1 kV and 15 kV, capacitor 312 may have a value between 4 microfarad (uF) and 2 millifarad (mF), and capacitor 320 may have a value between 70 nanofarad (nF) and 150 nF. The design and configuration of transformer circuit 306 is discussed in more detail below with regard to FIGS. 4 and 4A.

Figure 4A:
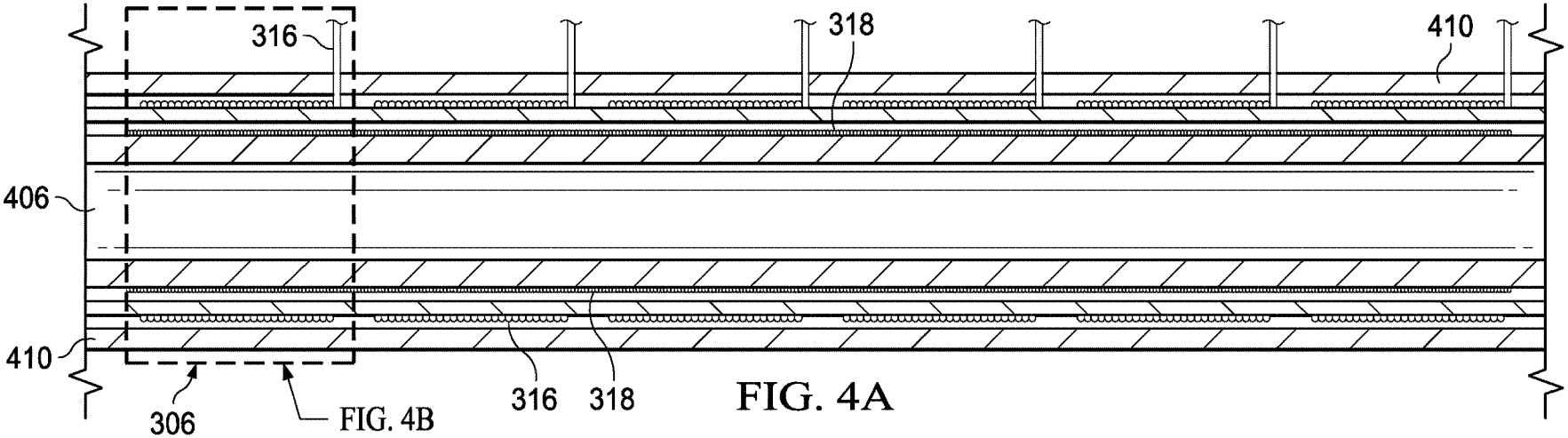
FIG. 4A is a side cross-sectional view of an exemplary transformer circuit for a downhole electrocrushing drilling system.
Figure 4B:
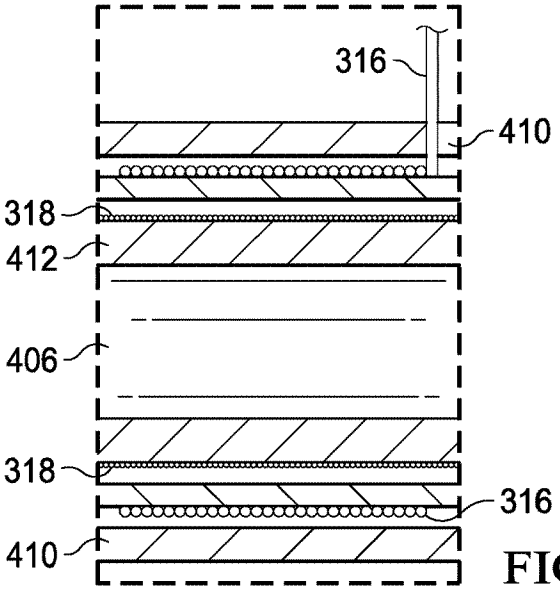
FIG. 4B is an exploded view of an exemplary transformer circuit for a downhole electrocrushing drilling system

FIG. 4A is a side cross-sectional view of an exemplary transformer circuit for a downhole electrocrushing and/or electrohydraulic drilling system, and FIG. 4B is an exploded view of the same. Transformer circuit 306 is voltage step-up transformer that includes primary windings 316 and secondary windings 318 around core 406 within housing 410. Primary windings 316 are comprised of multiple wires segments configured concentrically with secondary windings 318 to form an open-core transformer that operates in the manner described below. Insulating material 412 may be placed between primary windings 316 and secondary windings 318 to electrically isolate the windings and prevent electrical shorts between the wires in the windings. Insulating material 412 may include any electrically insulating materials, including those discussed below with respect to FIG. 5.

Multi-segmented primary windings 316 are formed of individual wire segments wrapped around core 406. The wire segments of primary windings 316 may be placed side-by-side along the length of core 406. The segmented wires of multi-segmented primary windings 316 are coupled to a common power source, such as power source input 302 of FIG. 3 via an input circuit, such as input stage circuit 304 of FIG. 3. As described above with reference to FIG. 3, an alternating current from the power source input flows through primary windings 316 such that the current creates a variable electromagnetism (i.e., magnetic flux) in and around secondary windings 318. Primary windings 316 include electrically conductive material, such as copper, formed in a solid or hollow shape with a circular or rectangular cross section. Although primary windings 316 are shown configured as a solenoid in FIGS. 4A and 4B, primary windings 316 may be configured in another arrangement around 406.

Secondary windings 318 of transformer circuit 306 also wrap around core 406 to form transformer circuit 306 with primary windings 316. Primary windings 316 are wrapped around secondary windings 318 and core 406 such that windings 316 and 318 are concentric relative to each other. Electromagnetism created by the flow of current in primary windings 316 induces current and voltage in secondary windings 318 due to electromagnetic induction. The current and voltage created in secondary windings 318 powers other elements, such as output stage circuit 308 of pulse-generating circuit 300 described above with respect to FIG. 3. Secondary windings 318 include electrically conductive material, such as copper, formed in a solid or hollow shape having a circular or rectangular cross section. Although secondary windings 318 are shown as being located within primary windings 316 in FIG. 4A, secondary windings 318 may wrap around primary windings 316 and core 406 such that windings 316 and 318 are concentric relative to each other. Secondary windings 318 may be configured in another arrangement around 406 other than the solenoid configuration illustrated in FIG. 4A.

Primary windings 316 and secondary windings 318 are configured to form a step-up transformer that transforms the low input voltage into a higher output voltage. The output voltage of transformer circuit 306 depends in part on the ratio of windings between primary windings 316 and secondary windings 318. Secondary windings 318 include a higher number of windings as compared to the total number of windings in primary windings 316. For example, secondary windings 318 may include between approximately 8 to 12 or more times as many windings as compared to primary windings 316. The higher ratio of secondary windings 318 to primary windings 316 transforms the low input voltage supplied by the power source on the primary side of transformer circuit 306 into a higher output voltage on the secondary side of transformer circuit 306. The increase of output voltage on the secondary side as compared to the input voltage on the primary side is approximately proportionate to the ratio of primary windings 316 to secondary windings 318. Thus, the ratio of secondary windings 318 to primary windings 316 enables transformer circuit 306 to transform the low voltage (for example, approximately 1 kV to 15 kV) from the power source input into an output voltage of at least 50 kV or between approximately 50 kV and 200 kV. The higher output voltage can be discharged in approximately 5 to 25 microseconds to create the high-energy pulses used for electrocrushing drilling. To enable a higher turn ratio, primary windings 316 may be formed of more wire segments having fewer turns, or secondary windings 318 may be located concentrically within primary windings 316 such that more secondary windings may be placed in a smaller area using minimal electrically conductive material.

The individual wires of primary windings 316 form a multi-segmented primary winding. Current from power source input flows through each wire segment of primary windings 316. Each wire segment has an electrical impedance that opposes the flow of current through the wire and varies based on the material, length, resistance, capacitance and/or other attributes of the wire. The wire segments of primary windings 316 are connected in parallel to a common power source input (for example, power source input 302 of FIG. 3) via an input circuit, such as input stage circuit 304 of FIG. 3. By arranging wires in parallel, the combined impedance for primary windings 316 is reduced such that more current (for example, between approximately 4 kA and 40 kA) may be supplied to primary windings 316 as compared to a transformer with non-segmented primary windings due to the reduced opposition to current flow in the wires. The increased current in primary windings 316 enables a higher operating power in addition to creating increased electromagnetism that enables a higher output voltage of transformer circuit 306. In addition, the reduced impedance of primary windings 316 reduces the amount of heat generated by the operation of transformer circuit 306, thereby reducing the operational energy loss and improving the energy transfer efficiency of the circuit as compared to a transformer circuit with non-segmented primary windings. Thus, multi-segmented primary windings 316 increase the operating power range and improve the efficiency of transformer circuit 306.

Transformer circuit 306 is designed as an open-core transformer to reduce the diameter of the pulse-generating circuit 300. In a closed-core transformer, the core material is formed in a ring to concentrate electromagnetism between the windings. By contrast, an open-core transformer, such as transformer circuit 306 with core 406, is formed of an elongated shape with a narrow cross-section (for example, a cylinder with a diameter between approximately 2 and 24 inches or 5 and 61 centimeters) such that transformer circuit 306 fits within a bottom-hole assembly (for example, BHA 128 discussed above with respect to FIGS. 1 and 2) of a drill bit (for example, drill bits 114 and 115 discussed above with respect to FIGS. 2A and 2B) utilized to drill a wellbore in a subterranean formation. Accordingly, the open-core design enables a smaller diameter for transformer circuit 306 that facilitates downhole placement.

An open-core design may result in decreased electromagnetic coupling between primary windings 316 and secondary windings 318 as compared to a closed-core design. Thus, the placement of primary windings 316 and secondary windings 318 is selected to enhance the electromagnetic coupling between the windings. Primary windings 316 are wrapped around secondary windings 318 in a concentric manner. As explained above, electromagnetism created by the flow of current in primary windings 316 induces current and voltage in secondary windings 318 due to electromagnetic induction. Some electromagnetism created on the primary side is lost due to materials near and the spacing between windings 316 and 318. To reduce this loss, windings 316 and 318 may be placed in close proximity to each other (for example, approximately 3 and 20 millimeters apart) to increase the electromagnetic coupling between the windings. The electromagnetic coupling may be expressed as a coupling coefficient, a fractional number between 0 and 1, where a lower coupling coefficient represents a smaller electromagnetic coupling and a higher coupling coefficient represents a higher electromagnetic coupling. The higher the coupling coefficient, the higher the induced current and voltage in secondary windings 318. The placement of windings 316 and 318 within transformer circuit 306 may achieve a coupling coefficient between approximately 0.4 and 0.8. Increasing the electromagnetic coupling between primary windings 316 and secondary windings 318 may reduce the electromagnetic loss between the windings and thereby improve the operating efficiency of transformer circuit 306. The close proximity between windings 316 and 318 may also help maintain a diameter for transformer circuit 306 that fits within a bottom-hole assembly (for example, BHA 128 discussed above with respect to FIGS. 1 and 2).

Transformer circuit 306 may be an open-core, air-core transformer that includes no added magnetic material. That is, the space between windings 316 and 318 may be filled with air or other non-ferromagnetic materials such that transformer circuit 306 is an air-core design. The air-core design of transformer circuit 306 helps avoid saturation common with magnetic core material and variability caused by the effect of extreme downhole operating conditions on the performance of core material.

Core 406 of transformer circuit 306 is located at or near the center of concentric windings 316 and 318. Primary windings 316 wrap around secondary windings 318, and both windings wrap around core 406. Due to its placement outside (not between the windings) of concentric windings, core 406 is not part of the magnetic circuit formed between primary windings 316 and secondary windings 318. Core 406 still affects the electromagnetic coupling between windings 316 and 318 because of its proximity and placement relative to the windings. For example, core 406 may concentrate fringe magnetic flux (i.e., fringe electromagnetism that is outside of the magnetic circuit formed between primary windings 316 and secondary windings 318) along the internal diameter of transformer circuit 306. Concentrating fringe magnetic flux near the center of transformer circuit 306 may reduce the amount of fringe magnetic flux that is lost as the flux intercepts and dissipates through other downhole components. Reducing flux in other downhole components may improve the electromagnetic coupling between windings 316 and 318, and thus the operating efficiency of transformer circuit 306. Similar to the space between primary windings 316 and secondary windings 318 discussed above, core 406 may be filled with air or other non-ferromagnetic material. However, core 406 may also include supplemental magnetic core material to help attract fringe magnetic flux along the internal diameter of transformer circuit 306. The chances of saturation for magnetic material within core 406 are eliminated because core 406 experiences less electromagnetic flux than the magnetic circuit between primary windings 316 and secondary windings 318, and the electromagnetic flux is not stored in the open-core configuration. The supplemental core added to core 406 may be selected to have lower variability in response to the extreme downhole operating conditions. For example, preferred supplemental core material includes a cobalt-iron alloy such as supermendur, which may include approximately forty-eight percent cobalt, approximately forty-eight percent iron, and approximately two percent vanadium by weight. The supermendur material maintains its high relative permeability across a wide range of temperatures (for example, from approximately 10 to 200 degrees Centigrade), and thus withstands the high temperatures of a downhole environment. The supplemental core material may also include a ferrite material, a strip laminate magnetic material with a Curie temperature 200 degrees Centigrade or greater, Metglas®, which includes a thin amorphous metal alloy ribbon which may be magnetized and demagnetized, or other high magnetic permeability material that maintains its magnetic permeability across a range of downhole temperatures (for example, from approximately 10 to 200 degrees Centigrade) such as Silectron™ (for example, silicon steel material composed of approximately 3% silicon steel and 97% iron) and Supermalloy™ (for example, composed of approximately 80% Nickel-Iron and approximately 20% iron alloy).

The various design features of transformer circuit 306 enable the circuit to operate at a high-power level while still physically fitting within the narrow confines of a wellbore. For example, multi-segmented primary windings 316 help reduce the impedance on the input side of transformer circuit 306 such that more input current can flow through the circuit. The multi-segmented primary windings 316 simultaneously reduce operational energy loss, thereby improving the operating efficiency of the circuit. A higher ratio of secondary windings 318 to primary windings 316 steps up the low input voltage to a higher output voltage that is used to generate high-energy pulses for electrocrushing or electrohydraulic drilling. Transformer circuit 306 may be configured with a narrow diameter due to its open-core design with concentric primary and secondary windings. The air-core design of transformer circuit 306 eliminates the risk of saturation common with magnetic core material and variability caused by the effect of extreme downhole operating conditions on the performance of the core material. Supplemental magnetic core material may be added to core 406, outside of the magnetic circuit of the transformer, to concentrate the fringe magnetic flux away from other downhole components, thereby reducing fringe magnetic flux loss and the operating efficiency of transformer circuit 306.

Transformer circuit 306 may be physically sized to fit in a downhole tool. The physical size of transformer circuit 306 may depend on the size of core 406, the number and size of primary windings 316 and secondary windings 318, the spacing between primary windings 316 and secondary windings 318, the dimensions of housing 410, and the arrangement and/or spacing of primary windings 316 and secondary windings 318 within housing 410. The length (along the X axis in FIG. 4A) of transformer circuit 306 may vary inversely with the width (along the Y axis of FIG. 4A) of transformer circuit 306. As transformer circuit 306 is made narrower to fit within wellbores with smaller diameters, the length of pulse-generating circuit 300 may increase to accommodate the materials and components comprising the circuit. Conversely, the length of pulse-generating circuit 300 may be decreased by increasing the width of pulse-generating circuit 300. The length of transformer circuit 306 may be between approximately 3 and 25 feet (between approximately 1 and 8 meters) and the diameter of the circuit may be between approximately 4 and 20 inches (between approximately 10 and 51 centimeters).

Figure 5:
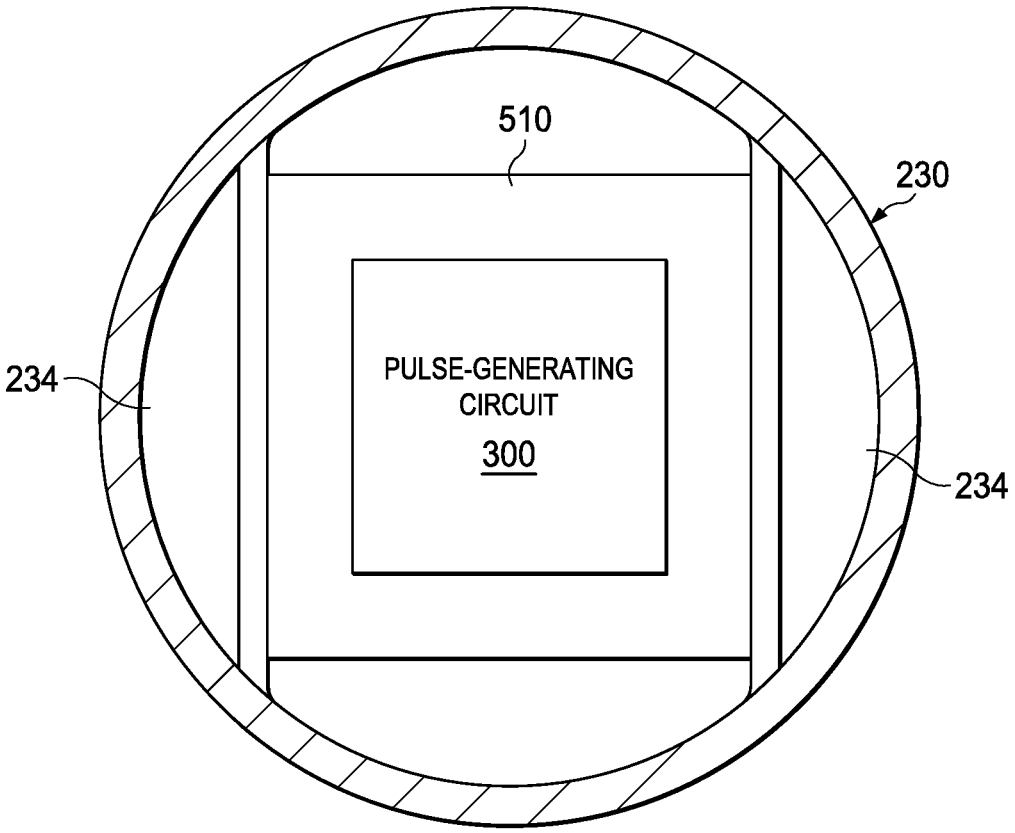
FIG. 5 is a top cross-sectional view of an exemplary pulsed-power tool for a downhole electrocrushing drilling system.

Pulse-generating circuit 300 may be encapsulated by insulating material to protect against the harsh downhole environment and facilitate dissipation of heat generated by the circuit. FIG. 5 is a top cross-sectional view of an exemplary pulsed-power tool for a downhole electrocrushing and/or electrohydraulic drilling system. Pulsed-power tool 230 includes pulse-generating circuit 300, the circuit depicted above in FIG. 3. Pulse-generating circuit 300 may be shaped and sized to fit within the circular cross-section of pulsed-power tool 230, which as described above with reference to FIGS. 2A and 2B, may form part of BHA 128. Pulse-generating circuit 300 may be enclosed within encapsulant 510 that includes a thermally conductive material to protect pulse-generating circuit 300 from the wide range of temperatures (for example, from approximately 10 to 200 degrees Centigrade) within the wellbore. For example, encapsulant 510 may include APTEK® 2100-A/B, which is a two-component, unfilled, electrically insulating urethane system for the potting and encapsulation of electronic components, and has a thermal conductivity of approximately 170 mW/mK. Encapsulant 510 may include one or more other thermally conductive materials with a dielectric strength greater than approximately 350 volt/mil (for example, greater than approximately 13,780 volt/millimeter) and a temperature capability greater than approximately 120 degrees Centigrade, such as DOW CORNING® OE-6636 and OE-6550, and Kapton® polyimide film. Encapsulant 510 adjoins an outer wall of one or more fluid channels 234. As described above with reference to FIG. 1, drilling fluid 122 passes through interior channels (for example, fluid channels 234) of drill string 108 as drilling fluid is pumped down through a drill string. Encapsulant 510 may transfer heat generated by pulse-generating circuit 300 to the drilling fluid that passes through fluid channels 234. Encapsulant 510 may also insulate pulse-generating circuit 300 from heat generated by other downhole components. Thus, encapsulant 510 may prevent pulse-generating circuit 300 from overheating to a temperature that degrades the relative permeability of core of the cores of the inductors in pulse-generating circuit 500.

Figure 6:
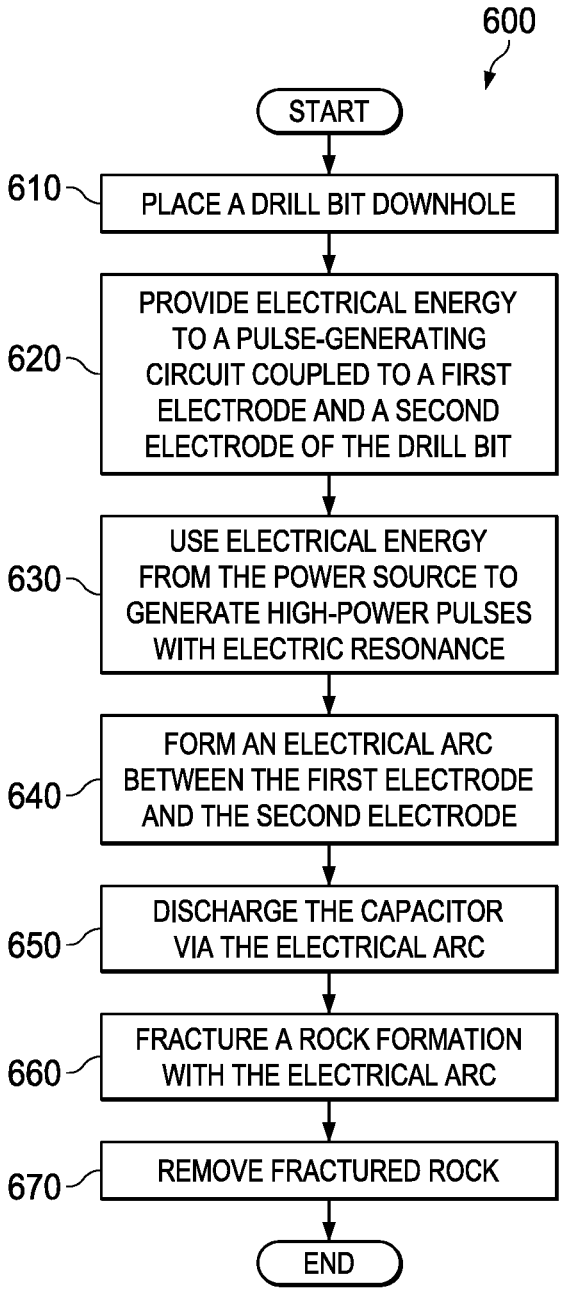
FIG. 6 is a flow chart of exemplary method for drilling a wellbore.

FIG. 6 illustrates a flow chart of exemplary method for drilling a wellbore.

Method 600 may begin and at step 610 an electrocrushing or electrohydraulic drill bit may be placed downhole in a wellbore. For example, drill bit 114 may be placed downhole in wellbore 116 as shown in FIG. 1.

At step 620, electrical energy is provided to a pulse-generating circuit coupled to a first electrode and a second electrode of the drill bit. The first electrode may be electrode 208, 210, or 212 and the second electrode may be ground ring 250 discussed above with respect to FIGS. 2A and 2B. For example, as described above with reference to FIG. 3, pulse-generating circuit 300 may be implemented within pulsed-power tool 230 of FIGS. 2A and 2B. And as described above with reference to FIGS. 2A and 2B, pulsed-power tool 230 may receive electrical power from a power source on the surface, from a power source located downhole, or from a combination of a power source on the surface and a power source located downhole. Power may be supplied downhole to pulse-generating circuit 300 by way of a cable, such as cable 220 described above with respect to FIGS. 2A and 2B. The power may be provided to pulse-generating circuit 300 within pulse-power tool 230 at power source input 302.

At step 630, the pulse-generating circuit converts the electrical power from the power source into high-energy electrical pulses for use of the electrocrushing drill bit. For example, as described above with reference to FIG. 3, pulse-generating circuit 300 may include an input stage circuit 304, transformer circuit 306, and an output stage circuit 308. Pulse-generating circuit 300 steps up the low-voltage input to a high-voltage output that is used to create high-energy pulses for the drilling system. For example, the pulse-generating circuit may use a higher ratio of secondary windings to primary windings in the transformer circuit to convert a low-voltage power source input (for example, approximately 1 kV to 15 kV) into high-energy electrical pulses capable of applying at least 50 kV or between approximately 50 kV and 200 kV across electrodes of the drill bit.

At step 640, an electrical arc may be formed between two electrodes of the drill bit. For example, an electrical arc may be formed between electrode 208 or 210 and ground ring 250 of electrocrushing drill bit 114 illustrated in FIG. 2A or electrode 212 and ground ring 250 of electrocrushing drill bit 115 illustrated in FIG. 2B.

And at step 650, a capacitor in output stage circuit may discharge via the electrical arc. For example, as the voltage across capacitor 320 of output stage circuit 308 increases during step 630, the voltage across the first electrode and the second electrode also increases. As described above with reference to FIGS. 1 and 2, when the voltage across the two electrodes (for example, electrode 208 and ground ring 250 illustrated in FIG. 3) becomes sufficiently large, an arc may form through a rock formation that is in contact with or near the electrodes. The arc may provide a temporary electrical short between electrode 208 and ground ring 250, and thus may discharge, at a high current level, the voltage built up across capacitor 320 illustrated in FIG. 3.

At step 660, the rock formation at an end of the wellbore may be fractured with the electrical arc. For example, as described above with reference to FIGS. 1 and 2, the arc greatly increases the temperature of the portion of the rock formation through which the arc flows as well as the surrounding formation and materials. The temperature is sufficiently high to vaporize any water or other fluids that may be touching or near the arc and may also vaporize part of the rock itself. The vaporization process creates a high-pressure gas which expands and, in turn, fractures the surrounding rock.

At step 670, fractured rock may be removed from the end of the wellbore. For example, as described above with reference to FIG. 1, electrocrushing drilling fluid 122 may move the fractured rock away from the electrodes and uphole away from the drill bit. As described above with respect to FIGS. 2A and 2B, electrocrushing drilling fluid 122 and the fractured rock may pass away from electrodes through passages 260 in the drill bit. Subsequently, method 700 may end.

Modifications, additions, or omissions may be made to method 700 without departing from the scope of the disclosure. For example, the order of the steps may be performed in a different manner than that described and some steps may be performed at the same time. Additionally, each individual step may include additional steps without departing from the scope of the present disclosure.

Embodiments herein may include:

A. A downhole drilling system including a pulse-generating circuit electrically coupled to a power source configured to provide an alternating current at a frequency and an input voltage, the pulse-generating circuit comprising an input stage circuit electrically coupled to the power source, the input stage circuit configured to control the alternating current in the pulse-generating circuit; a transformer circuit electrically coupled to the input stage circuit, the transformer circuit comprising an open-core transformer configured to generate an output voltage higher than the input voltage; and an output stage circuit electrically coupled to the transformer circuit, the output stage circuit configured to store energy for an electric pulse; and a drill bit including a first electrode and a second electrode electrically coupled to the output stage circuit to receive the electric pulse from the pulse-generating circuit.

B. A method including providing an alternating current and an input voltage from a power source at a frequency to a pulse-generating circuit electrically coupled to a drill bit located downhole in a wellbore; generating an electric pulse with the pulse-generating circuit, the electric pulse stored in an output capacitor and generated at the frequency by an open-core transformer, forming an electrical arc between a first electrode and a second electrode of the drill bit, the first electrode and the second electrode electrically coupled to the output capacitor; discharging the output capacitor by the electrical arc; fracturing a rock formation at an end of the wellbore with the electrical arc; and removing fractured rock from the end of the wellbore.

Each of embodiments A and B may have one or more of the following additional elements in any combination: Element 1: wherein the input stage circuit comprises a capacitor; and a switch coupled to the capacitor, the switch configured to open and close an electrical path between the capacitor and the transformer circuit, the alternating current from the power source passing to the transformer circuit when the electrical path is closed. Element 2: wherein the transformer circuit further comprises a plurality of primary windings electrically coupled to the input stage circuit; and a plurality of secondary windings concentric to and electromagnetically coupled to the primary windings, the primary and secondary windings forming the open-core transformer. Element 3: wherein the open-core transformer is further configured as an air-core transformer having no ferromagnetic material. Element 4: wherein the primary windings are comprised of a plurality of segmented wires coupled to the input stage circuit. Element 5: wherein the primary and secondary windings are wound around a core. Element 6: wherein the core concentrates a fringe magnetic flux of the primary and secondary windings. Element 7: wherein the frequency is less than 100 MHz. Element 8: wherein the electric pulse from the pulse-generating circuit applies a voltage of at least 50 kV across the two electrodes. Element 9: wherein the drill bit is integrated within a bottom-hole assembly. Element 10: wherein the drill bit is one of an electrocrushing drill bit and an electrohydraulic drill bit. Element 11: wherein one of the two electrodes is a ground ring. Element 12: wherein the pulse-generating circuit comprises an input stage circuit electrically coupled to the power source, the input stage circuit configured to control the alternating current in the pulse-generating circuit; a transformer circuit electrically coupled to the input stage circuit, the transformer circuit comprising the open-core transformer configured to generate an output voltage higher than the input voltage with the voltage step-up transformer; and an output stage circuit electrically coupled to the transformer circuit, the output stage circuit configured to store an energy from the output voltage.

The embodiments described in the present disclosure are intended for use in electrocrushing and/or electrohydraulic drilling, and reference to one or the other form of drilling in the above disclosure is not intended to limit the applicability of the embodiment to that particular form of drilling. Although the present disclosure has been described with several embodiments, various changes and modifications may be suggested to one skilled in the art. It is intended that the present disclosure encompasses such various changes and modifications as falling within the scope of the appended claims.

What is claimed is:

1. A downhole drilling system, comprising:

a bottom hole assembly within a wellbore configured to receive drilling fluid from a drill string;

a pulse-generating circuit within the bottom hole assembly and electrically coupled to a power source configured to provide an alternating current at a frequency and an input voltage, the pulse-generating circuit comprising:

an input stage circuit electrically coupled to the power source, the input stage circuit configured to control the alternating current in the pulse-generating circuit;

a transformer circuit electrically coupled to the input stage circuit, the transformer circuit comprising an open-core transformer configured to generate an output voltage higher than the input voltage and allow drilling fluid to flow through the open-core transformer; and an output stage circuit electrically coupled to the transformer circuit, the output stage circuit configured to store energy for an electric pulse; and a drill bit including a first electrode and a second electrode electrically coupled to the output stage circuit to receive the electric pulse from the pulse-generating circuit.

2. The downhole drilling system of claim 1, wherein the input stage circuit comprises:

a capacitor; and a switch coupled to the capacitor, the switch configured to open and close an electrical path between the capacitor and the transformer circuit, the alternating current from the power source passing to the transformer circuit when the electrical path is closed.

3. The downhole drilling system of claim 1, wherein the transformer circuit further comprises:

a plurality of primary windings electrically coupled to the input stage circuit; and a plurality of secondary windings concentric to and electromagnetically coupled to the primary windings, the primary and secondary windings forming the open-core transformer.

4. The downhole drilling system of claim 3, wherein the open-core transformer is further configured as an air-core transformer having no ferromagnetic material.

5. The downhole drilling system of claim 3, wherein the primary windings are comprised of a plurality of segmented wires coupled to the input stage circuit.

6. The downhole drilling system of claim 3, wherein the primary and secondary windings are wound around a core.

7. The downhole drilling system of claim 6, wherein the core concentrates a fringe magnetic flux of the primary and secondary windings.

8. The downhole drilling system of claim 1, wherein the frequency is less than 100 MHz.

9. The downhole drilling system of claim 1, wherein the electric pulse from the pulse-generating circuit applies a voltage of at least 50 kV across the two electrodes.

10. The downhole drilling system of claim 1, wherein the drill bit is one of an electrocrushing drill bit and an electrohydraulic drill bit.

11. The downhole drilling system of claim 1, wherein one of the two electrodes is a ground ring.

12. A method, comprising:

receiving drilling fluid at a bottom hole assembly within a wellbore;

providing an alternating current and an input voltage from a power source at a frequency to a pulse-generating circuit electrically coupled to a drill bit located downhole in a wellbore;

generating an electric pulse with the pulse-generating circuit within the bottom hole assembly and, the electric pulse stored in an output capacitor and generated at the frequency by an open-core transformer, wherein the pulse-generating circuit comprises:

an input stage circuit electrically coupled to the power source, the input stage circuit configured to control the alternating current in the pulse-generating circuit;

a transformer circuit electrically coupled to the input stage circuit, the transformer circuit comprising the open-core transformer configured to generate an output voltage higher than the input voltage and allow drilling fluid to flow through the open-core transformer; and an output stage circuit electrically coupled to the transformer circuit, the output stage circuit configured to store an energy from the output voltage;

forming an electrical arc between a first electrode and a second electrode of the drill bit, the first electrode and the second electrode electrically coupled to the output capacitor;

discharging the output capacitor by the electrical arc;

fracturing a rock formation at an end of the wellbore with the electrical arc; and removing fractured rock from the end of the wellbore.

13. The method of claim 12, wherein the input stage circuit comprises:

a capacitor; and a switch coupled to the capacitor, the switch configured to open and close an electrical path between the capacitor and the transformer circuit, the alternating current from the power source passing to the transformer circuit when the electrical path is closed.

14. The method of claim 12, wherein the transformer circuit comprises:

a plurality of primary windings electrically coupled to the input stage circuit; and a plurality of secondary windings concentric to and electromagnetically coupled to the primary windings, the primary and secondary windings forming the open-core transformer.

15. The method of claim 14, wherein the primary windings are comprised of a plurality of segmented wires coupled to the input stage circuit.

16. The method of claim 14, wherein the primary and secondary windings are wound around a core.

17. The method of claim 16, wherein the core concentrates a fringe magnetic flux of the primary and secondary windings.

18. The method of claim 12, wherein the frequency is less than 100 MHz.

19. The method of claim 12, wherein the electric pulse from the pulse-generating circuit applies a voltage of at least 50 kV across the first electrode and the second electrode.

20. The method of claim 12, wherein the drill bit is one of an electrocrushing drill bit and an electrohydraulic drill bit.

21. The method of claim 12, wherein one of the first and second electrode is a ground ring.

* * * * *